United States Patent [19]

Gustavsson et al.

[11] 4,384,739

[45] May 24, 1983

[54] LIFTING DEVICE FOR AMMUNITION

[75] Inventors: Olle Gustavsson; Göran Sundmar, both of Karlskoga, Sweden

[73] Assignee: Aktiebolaget Bofors, Bofors, Sweden

[21] Appl. No.: 217,593

[22] Filed: Dec. 18, 1980

[30] Foreign Application Priority Data

Dec. 18, 1979 [SE] Sweden ..... 7910437

[51] Int. Cl.[3] ..... B66C 1/62

[52] U.S. Cl. ..... 294/87 R; 294/67 BC

[58] Field of Search ..... 294/63 R, 67 R, 67 AB, 294/67 B, 67 BC, 81 R, 87 R, 113, 114; 89/1.5 H, 46

[56] References Cited

U.S. PATENT DOCUMENTS

| | | | |
|---|---|---|---|
| 1,039,727 | 10/1912 | Gilmartin | 294/114 X |
| 1,564,655 | 12/1925 | Westbo | 294/67 BC |
| 2,213,718 | 9/1940 | Reed et al. | 294/81 R |
| 2,365,930 | 12/1944 | Bayhi et al. | 294/87 R |
| 3,081,124 | 3/1963 | Kaplan | 294/67 BC X |

FOREIGN PATENT DOCUMENTS

| | | | |
|---|---|---|---|
| 134632 | 3/1979 | Fed. Rep. of Germany | 294/67 BC |
| 237364 | 6/1969 | U.S.S.R. | 294/67 BC |

*Primary Examiner*—Johnny D. Cherry

*Attorney, Agent, or Firm*—Pollock, Vande Sande & Priddy

[57] ABSTRACT

A lifting device is used for live or practice ammunition, for which the device comprises a number of gripping elements. The gripping elements are made with a number of elements extending from the frame of the lifting device. The elements form pairs of elements that can be allotted each to its shell during the lifting. The elements are rotatably supported around their longitudinal axes in the frame and at their free ends have widened sections extending in one direction. The elements are rotatable to first rotation positions where the respective pair of elements from the side can be moved over a round of ammunition. In second rotation positions the respective pair of elements encloses its shell with the aid of the widened sections and secures the shell against movement in the transversal direction. At the respective pair of elements there is also arranged a holding trough which is rotatably supported via its back section in the frame so that its parts directed towards the sections in the pair of elements in question carry out a displacing movement towards the sections. Also a lifting hook is included, which in one embodiment is connected with the holding troughs via a linkage system so that the rotary movements and positions of the holding troughs in relation to the sections of the elements are controlled with the aid of the own weight of the shells and the lifting device.

6 Claims, 7 Drawing Figures

LIFTING DEVICE FOR AMMUNITION

The present invention relates to a lifting device for live or practice shells, projectiles, rounds, rocket-assisted projectiles, or corresponding ammunition. The lifting device then comprises a number of gripping means which are movable into coaction with one or a plurality of units at a time, e.g. three units.

BACKGROUND ART

The lifting device can be utilized in field service, e.g. at an artillery piece in the form of a field howitzer where the ammunition in question or parts thereof is to be transferred from an ammunition carrier or the like to a loading table or the like. However, the lifting device can also be used in other situations, such as in storage premises or the like, when ammunition is to be moved from one place to another.

Various types of lifting devices are therefore previously known.

DISCLOSURE OF THE INVENTION THE TECHNICAL PROBLEM

With lifting devices of this kind, it is desirable that the lifting device in question be used to grip the shells or the like from packages or handling racks in which the shells can be kept in both horizontal and vertical positions, or intermediate positions. There is also a desire that at the new storing or unloading site the shells may be placed in arbitrary positions, i.e. in vertical or horizontal positions, or in intermediate positions.

THE SOLUTION

The purpose of the lifting device according to the present invention is to solve the above-mentioned problems in addition to providing a simple and efficient lifting function. The features which, in accordance with the invention, make the solution of these problems possible are that the gripping means on the lifting device comprise a number of elements extending from the frame and substantially parallel to each other which are rotatably arranged around their longitudinal axes between first and second positions. The elements are placed adjacent to each other to form pairs of elements which can be allotted to a unit (shell). The respective rotary element at its free end is made with a widened section in one direction, so that in the first rotation position of the elements of the respective pair of elements these sections are set so the pair of elements is movable over its unit from the side with the elements of the pair of elements extending on either side of the unit. In the second rotation position of the elements the pair of elements with the aid of said sections partly or entirely enclose the unit to restrain the unit against movements in the transversal direction of the unit.

In further developments of the invention in which the ammunition handling is further simplified, more detailed embodiments of the design are adopted which comprise counter-support means in the form of specifically designed holding troughs which have an internal clearance or recess for the driving band of a shell also arranged to grip the shell around a front bourrelet or guide lugs which may possibly be found on certain ammunition. Furthermore, the further developments include the details of a design of a lifting hook belonging to the device to which a hoisting crane or travelling crane is connected for lifting the device having ammunition loaded into it.

However, the features that can mainly be considered to be characteristic for a lifting device according to the invention will be noted from the following claims.

ADVANTAGES

With the invention, a lifting device is created which in addition to the problems relating to the various positions of the shell or the like at the fetching and depositing sites makes it possible in connection with the further developments to easily lift and handle ammunition of various configurations and weights. As regards the configuration, the ammunition can vary considerably as to the length, and also the distance between the rear end and the driving band. Also, other shapes of the ammunition, e.g. the presence of a front bourrelet, guide lugs, etc., are not required for efficiently utilizing the lifting device.

BRIEF DESCRIPTION OF DRAWINGS

Embodiments proposed at present for a lifting device which has the characteristics significant to the invention will be described in more detail in the following, with reference to the accompanying drawings, in which.

BEST MODE OF CARRYING THE INVENTION

Figure 1A:
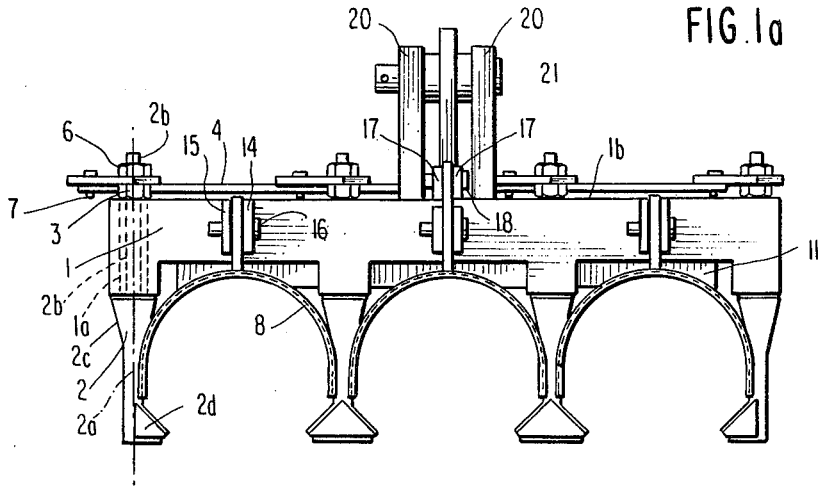
FIG. 1*a* shows the lifting device in a first embodiment, from the rear.
Figure 1B:
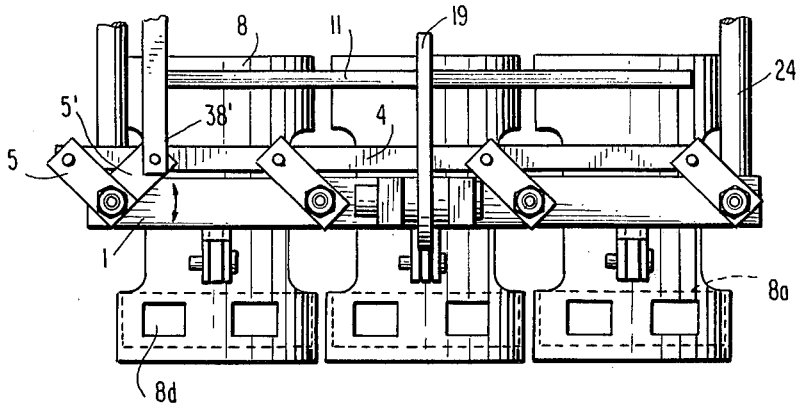
FIG. 1*b* shows the lifting device according to FIG. 1*a* from above.
Figure 1C:
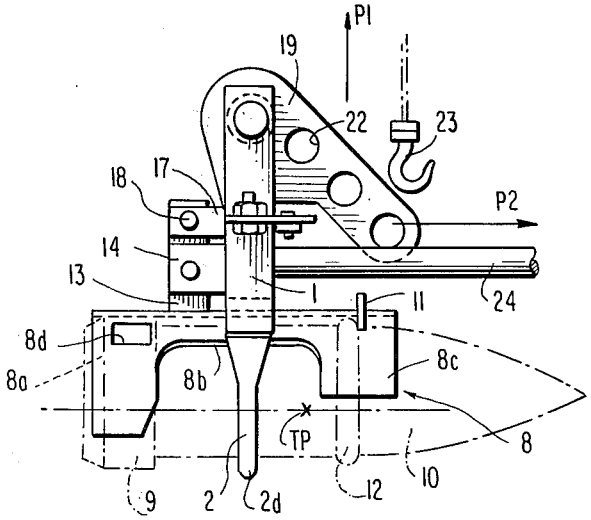
FIG. 1*c* shows the lifting device according to FIGS. 1*a* and 1*b* from one side.

As shown in FIGS. 1*a*–1*c*, the lifting device comprises a frame which has an elongate beam 1. In the beam there are supported a number, in the example of the embodiment, four, of elongate elements 2. Each element is rotatably supported around it longitudinal axis 2*a* in a recess 1*a* allotted to this purpose in the beam 1. The recess 1*a* is elongate and the supported part 2*b* of the respective element extends through the entire recess and out over the upper surface 1*b* of the beam 1 and the part extending above said surface can have threads. The element is retained in the container by a first nut applied on the threaded part, and also a conical part 2*c* located adjacent to the supporting part 2*b* and which has a diameter which exceeds the diameter of the recess in the frame. In its other end, which constitutes a free end, the element is made with a widened section 2*d*.

The elements 2 extend parallel to each other from the under side of the beam 1 and two elements located beside each other form a pair of elements. The two middle elements comprise common elements in two adjacent pairs of elements. The widened sections of the two middle pairs of elements thereby obtain substantially a T-form, while the sections of the outer elements are widened only in one direction.

Further, the widening of the respective section is made in only one direction, viz. the direction which coincides with the plane shown in FIG. 1*a*. In the direction turned 90° in relation to said plane according to FIG. 1*a*, i.e. in the direction that coincides with the plane of FIG. 1*c*, the respective element has a uniform thickness at its free end.

The elements are rotatably supported between first rotation positions which correspond to positions at right angles to those according to FIG. 1*a* and second rotation positions which correspond to the positions according to said FIG. 1*a*.

In the present example of the embodiment, the operation of the elements is carried out manually and simultaneously with a link rod 4 and link arms 5 which connect the respective elements with the link rod. The link arms are connected to the elements by means of a further nut 6 and engaging means not specially shown for the supporting part 2*b* on the respective element. The engaging means are then made in a way which is known in itself, so that when the link arms are turned in their plane according to FIG. 1*b* the element is forced down to the corresponding degree. The link rod and the link arms are connected via pivot supports 7. When the link rod assumes the position shown in FIG. 1*b* the elements assume their second rotation positions. When the link rod has been moved to the right in FIG. 1*b* the elements assume their first rotation positions, where the widened sections are directed upwards and coincide with a plane at right angles to the plane of FIG. 1*b*. The link rod is arranged so that it can be locked in its two end positions by means of an operating gear which will be described.

The pairs of elements are each allotted a round of ammunition, and in the example of the embodiment three parallel rounds can thus be lifted with the lifting device. The lifting device can, of course, also be made to accommodate a different number of pairs of elements, for instance two, four, five, or more.

The lifting device also comprises counter-support means in the form of so-called holding troughs 8, of which each pair of elements has its holding trough which then extends on either side in relation to the pair of elements viewed from the front or rear side of the lifting device. In the example of the embodiment the holding trough extends substantially an equal distance in both directions in relation to the pair of elements. At its rear section the holding trough is semicircular, with two smaller straight parts which are in connection with the ends of the semicircular form. The rear section is made with an internal groove or a recess 8*a* which can be allotted to a driving band 9 of a shell 10 placed between the pair of elements and the holding trough. The rear section is also designed to facilitate the guiding of the lifting device into place at the unloading site.

At its middle parts 8*b* the holding trough is recessed under the diameter of the semicircle to facilitate unloading on a loading table or the like. The holding trough is again widened to the circumference at its front section 8*c* where moreover on its back side it is connected to a means 11 connecting the various holding troughs of pairs of elements. The front section of the holding trough is designed to hold the shell over a possible front bourrelet 12, guide lugs, or the like. The front part is nearly semicircular. In connection with the internal groove 8*a* the respective holding trough is made with one or a plurality, e.g. two, of through holes 8*d* for inspection, which facilitate the application of the lifting device itself to the shells in question or the like. On its rear side the holding trough has a sheet-formed supporting part 13 which at its one end is fastened, for example through welding, to the material of the holding trough. In the case of the two outer holding troughs the supporting part 13 is rotatably supported at its other ends by means of two extending parts 14, 15, serving as a fork support, in which the supporting part is supported on a journal 16. For the middle holding trough the supporting part 13 is extended and is supported in said extending parts 14, 15 with journal 16, serving as a fork connection, at its middle parts. In the last-mentioned case, the supporting part is connected at its other end to two parallel link parts 17 via a further pivot support 18. The two parallel link parts are in turn connected in a third pivot support to a lifting hook 19 suspended as a lever, which at its middle part is supported in the frame via a fork support 20 which comprises a supporting shaft 21. The lifting hook is substantially V-formed and at its free end has a number, in the example of the embodiment three, of fastening holes 22 for a hook 23 on a hoisting crane or travelling crane (not shown in detail). Through said three fastening holes various torques can be obtained on the lever, as described in the following. The supporting part 13 is then in connection with the rear side of the holding trough at a section which is located between the middle parts of the holding trough which are opposite the sections 2*d* and the internal groove 8*a* of the pair of elements in question.

Through the arrangement shown, the holding troughs arranged between the elements in the pairs of elements will be rotatably supported in such a way that the middle parts of the holding troughs, in addition to a rotary movement carry out a certain displacing movement in the direction away from and towards the free ends of the elements or the widened sections. The degree of displacement of the holding troughs in relation to the sections is determined by the angle of rotation of the lifting hook 19 in its support 21. Through the linkage system described, the rotation of the lifting hook is transferred to the middle holding trough which, in turn, is connected together with the other two holding troughs via the connection means 11, and the outer holding troughs will follow the rotation of the lifting hook.

There is also a frame 24, which is only partly shown, and which serves as a handle, connected to the main frame. The frame extends at right angles outwards in relation to the beam 1 and the elements 2 so that it is substantially parallel to the back sides of the holding troughs.

The lifting device described above functions in the following way. The elements 2 are set at their first rotation positions by means of the link rod 4. In this situation the lifting device, suspended in a hoisting crane for example, and with manual guiding assistance via the handle, can be moved towards a shell, or two or three shells placed parallel to each other from the side, so that for the respective shell or the like the elements in the pair of elements in question will extend on either side of the shell. The guiding is facilitated by the inspection holes 8*d*.

The elements are thereafter actuated to their second rotation positions by means of the link rod 4, and the shell or shells will be held fast by means of the elements. At the guiding, it should also be ensured that the driving band of the respective shell will be positioned in the groove 8*a* of the respective holding trough.

Thereafter the device is lifted in the lifting hook 19 with the hoisting crane, and that the holding troughs will carry out a rotary movement during which they are urged towards the sections 2*d* of the elements. The holding troughs will then adjust themselves in relation to the circumference of the shells, and squeeze against the shells, which in turn are pressed against the widened sections, whereby the shell or shells will be held securely in the lifting device, it being assumed in the last-mentioned case that the units lifted at one and the same time are of the same type.

When the lifting device with the ammunition carried by it is set down on the storage or unloading site, the lifting force in the lifting hook 19 ceases, and the pressure from the respective holding trough against the respective shell decreases, and the link rod 4 can then easily be actuated and the elements moved to their first rotation positions, where the elements can be released from the shell or shells, etc.

The respective shell is fixed in the longitudinal direction to the respective holding trough by the driving band 9 being placed in the groove 8*a*, which thus prevents the shell from slipping out of the grip of the lifting device. Through the groove 8*a* in the respective holding trough the driving band of the shell is secured independent of the locking grip between the element and the holding trough. Through the embodiment described it is possible to grip and lift shells which have different distances between the driving band and rear end. The locking principle involves that variations in lengths can be permitted, i.e. variations between shells of different kinds, such as high-explosive shells, illuminating shells, smoke shells, rocket-assisted projectiles, and other extremely long-range shells. The lifting device also adapts itself to variations in tolerances of the driving bands of the ammunition in question.

The holding troughs and elements have also been designed in such a way that the center of gravity Tp of shells of all types will be located in front of the rotary elements, whereby the own weight of the shells is utilized as an aid for securing. As it is possible, when lifting ammunition of various kinds, to vary the above-mentioned torque lever of the lifting hook 19 which is suspended as a lever, regardless of the type of shell, the shells can be carried substantially horizontally in the lifting device when this is suspended in the lifting hook, which facilitates the manual guiding with the handle 24.

With the lifting device described above, the shells can be lifted regardless of their position in space and they can also be delivered in vertical, horizontal, or intermediate positions. In FIG. 1*c* two lifting directions of the lifting device have been indicated by P1 and P2, the lifting direction P1 then relating to the direction with horizontal ammunition and P2 the direction for ammunition in a vertical position.

In principle, it is possible to allow the holding troughs to be self-guiding, i.e. arranged without control from the lifting hook. An embodiment with holding troughs 8' which are not supported controlled and which moreover are individually rotatably supported in the frame is shown by the embodiment according to FIGS. 2*a*–2*c*, in which the corresponding parts have been given the same reference designations as in FIGS. 1*a*–1*c*, but have been supplemented with prime signs. In this case the holding troughs are rotatably supported each in a separate fork support 25, 26, with its supporting pin 27, arranged in the beam 1'. Further, there is no linkage arm connection to the lifting hook, which in this case has moreover been modified so that it comprises a curved yoke part 28 and a lifting means 29. At its ends, the yoke part is fastened in the beam, for example by welding. The means 29 is sheet-formed, and also comprises three lifting holes 30 to obtain different torque levers for the lifting force. Also in this case the shells are carried in the pairs of elements and holding troughs so that their centers of gravity in each case will be in front of the elements. Through the choice of fastening holes 30 for the hoisting crane or the like, the lifting device can be made to carry the shells substantially horizontally. Also this embodiment can have inspection holes which, however, have not been shown, for the sake of clearness.

Figure 2A:
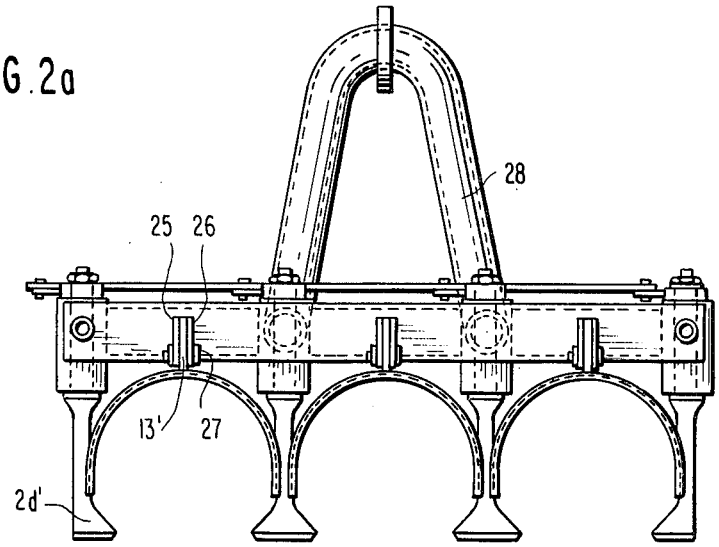
FIG. 2*a* shows the lifting device in a second embodiment, from the rear.
Figure 2B:
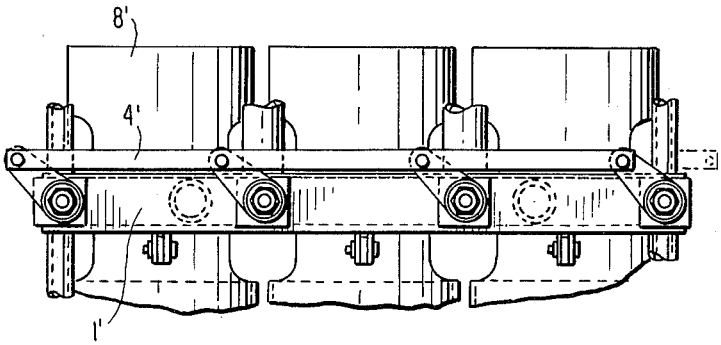
FIG. 2*b* shows the lifting device according to FIG. 2*a* from above.
Figure 3:
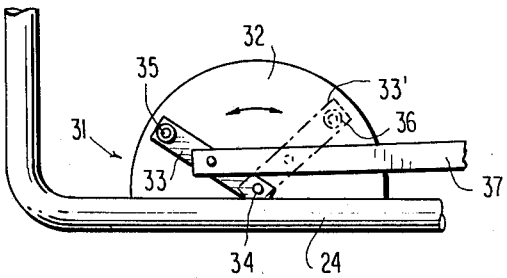
FIG. 3 shows parts of the operating gear in the lifting device from above.
Figure 2C:
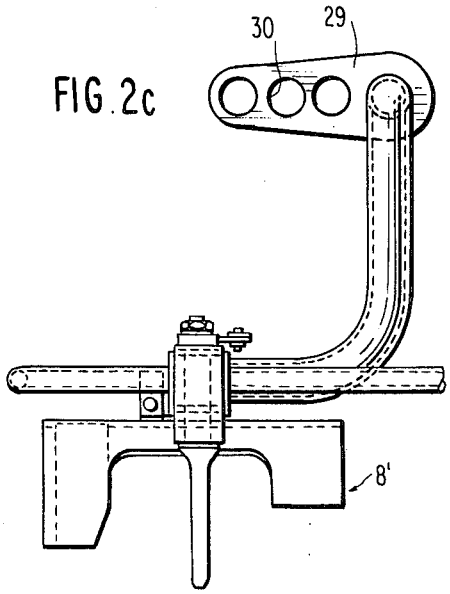
FIG. 2*c* shows the lifting device according to FIGS. 1*a* and 1*b* from the side.

The lifting device shown in FIGS. 2*a*–2*c* functions in principle in the same way as the embodiment according to FIGS. 1*a*–1*c*, but with the difference that the coordinated control of the positions of the holding troughs by means of the weight of the lifting device and the shells is not obtained. In this case the holding parts adjust themselves in relation to the envelope surfaces of the shells carried. This embodiment is appropriate in cases when shells which are placed horizontally are moved to horizontal positions on the unloading site. FIG. 3 shows a control gear 31 for the link rod 4 (see e.g. FIG. 1*b*). The control gear comprises a plate 32 fastened in the handle 24, on which plate a manual actuating means 33 is rotatably supported in a rotary support 34. The means 33 can be actuated between two end positions, one of which is shown by solid lines 33 and one with dash lines 33'. The means has a trunnion 35 which in the respective end position finds its way down into a hole 36 arranged in the respective end position on the plate 32. The means 33 is connected to a link rod 37, which, in turn, is connected to a link arm 5' via a rotary support 38'. The link arms 5 and 5' are connected together via the supporting part 2*b*. When the means is set in position 33 according to the figure the link rod 4 assumes its one end position. When the means is set in position 33' the rod 4 assumes its other end position. The means 33 is spring loaded so that the journal 35 will seek the holes 36 and when actuated to the other position a lifting movement of the means shall be made to release the journal 35 from the hole 36.

The invention is not limited to the embodiments shown as examples, but can be subject to modifications within the scope of the following claims.

INDUSTRIAL APPLICABILITY

The lifting device achieved through the invention is simple and economic to manufacture with an efficient manufacturing process, and is suitable as an object for licensing.

We claim:

1. A lifting apparatus for ammunition comprising:

a frame;

a plurality of at least three linearly spaced gripping units for gripping a plurality of ammunition components, said gripping units comprising first and second spaced apart gripping elements extending from the underside of said frame, said gripping elements rotatably connected at one end to said frame, the remaining free ends of said elements including a widened portion, a middle gripping unit having gripping elements which are formed from interior gripping elements of remaining gripping units, linkage means mounted to said frame for rotating said gripping elements 90° from a first position where said widened portions face each other to a position where they are parallel to each other; and an arcuate holding trough element located between said gripping elements, extending from said frame towards said free ends, open to receive an ammunition unit, said holding trough element including at one end a recess for receiving a driving band on an ammunition unit whereby said ammunition unit is restrained from longitudinal movement, said holding trough element having an opposite end shaped to permit a gripped ammunition unit to be held over a front bourrelet or guide lugs, said holding trough element at its back section being supported to the frame in a rotary support for rotary movement in relation to said frame whereby the holding trough element is supported in the frame so that its front section carries out a displacement movement in the direction towards or away from said gripping element free ends;

said frame and gripping units being positionable over said ammunition units, whereby said units are received in said holding trough elements with said gripping elements in said 90° position, and maintained within said holding trough element when said gripping elements are rotated to said first position permitting said frame, gripping units and ammunition units to be moved together.

2. A lifting apparatus according to claim 1, wherein said linkage means includes a link rod connected with an operating gear which can be locked when the link rod is at first and second end positions.

3. The lifting apparatus according to claim 1 further comprising means connecting the holding trough elements whereby said holding trough elements may be rotated together.

4. A lifting apparatus according to claim 3, further including a lifting hook means connected to rotate said holding trough elements towards said gripping elements free ends, whereby a vertical displacement of said hook means in cooperation with the gravitational force acting on said trough element displaces said trough elements toward said gripping element free ends.

5. A lifting device according to claim 4, wherein the lifting hook means is fastened to the frame as a lever, a first end of said hook means being connected with the holding trough elements, and to the second end of which is adapted to be connected to a crane.

6. A lifting device according to claim 5, wherein the lifting hook means at its second end includes a number of fastening points for said crane, to form torque levers of different length, whereby the fastening points are chosen in such a way that the lifting device in its suspended state carries the ammunition in a substantially horizontal position.

* * * * *